United States Patent [19]

Radek

[11] 3,969,009

[45] July 13, 1976

[54] HANDLE

[75] Inventor: John R. Radek, Hinsdale, Ill.

[73] Assignee: Ready Metal Manufacturing Co., Chicago, Ill.

[22] Filed: May 21, 1975

[21] Appl. No.: 579,674

[52] U.S. Cl. ..... 312/320; 16/124

[51] Int. Cl.[2] ..... A47B 95/02

[58] Field of Search ..... 312/320; 16/114 R, 110.5, 16/124

[56] References Cited

UNITED STATES PATENTS

| | | | |
|---|---|---|---|
| 1,304,700 | 5/1919 | Otte | 312/320 |
| 2,012,857 | 8/1935 | Scheinman et al. | 312/320 |
| 2,335,391 | 11/1943 | Cushing | 312/320 |
| 3,098,686 | 7/1963 | Benoit | 312/320 |
| 3,107,389 | 10/1963 | Engelbrecht | 312/320 |
| 3,122,402 | 2/1964 | Bullock et al. | 312/320 |
| 3,209,939 | 10/1965 | Terry et al. | 16/110.5 |
| 3,646,634 | 3/1972 | Fusselman | 312/320 |

FOREIGN PATENTS OR APPLICATIONS

| | | | |
|---|---|---|---|
| 1,273,151 | 7/1968 | Germany | 312/320 |

*Primary Examiner*—Paul R. Gilliam
*Assistant Examiner*—Victor N. Sakran
*Attorney, Agent, or Firm*—Frank H. Marks

[57] ABSTRACT

A handle for a drawer of an article of furniture, designed especially for optimum economy of production combined with attractive appearance susceptible of wide esthetic variation. These objectives are accomplished by mass production methods, preferably by molding or casting inexpensive materials, preferably plastics, and so forming cooperating parts of the handle and drawer that assembly may quickly be accomplished without use of tools, as by merely snapping the handle into place.

3 Claims, 8 Drawing Figures

HANDLE

My invention relates generally to handles to facilitate sliding or other movement of small elements, and is especially applicable to drawers of furniture known as "case goods." In such case an item embodying my invention might be called a drawer pull.

My invention, while primarily utilitarian and intended for application to cabinets in places of business such as offices, stores and factories, nonetheless is susceptible to a wide scope of esthetic treatment.

BACKGROUND

Drawer pulls are generally old in various forms such as knobs, balls, recessed fixtures adapted to receive part of a person's hand, etc.

BRIEF OUTLINE OF INVENTION

A particular object of my invention is to provide a handle for a drawer or the like susceptible of mass production at low cost, which is convenient in use and also susceptible to wide esthetic variation.

While not necessarily so restricted, my invention is especially designed for production by standard molding practices, employing known or other plastics having high impact resistance, and thus characterized by high durability under rough usage.

A special feature of handles embodying my invention is that they are designed, in connection with the drawer or other item with which assembled, to be capable of being securely and permanently locked in place without screws, but further designed to permit use of screws for additional security. However, they may readily be removed if desired for replacement.

Various other objects and advantages will suggest themselves to those skilled in the art as the description proceeds.

BRIEF DESCRIPTION OF THE DRAWINGS

Referring now to the drawings forming a part of this specification and illustrating a preferred embodiment of my invention.

DETAILED DESCRIPTION

Numeral 10 indicates a slidable drawer for an article of case goods such as a chest, table, desk or cabinet, having side panels 12, 12 and a front panel 13 carrying a handle H embodying my invention.

My invention is especially applicable to a front panel 13 of sheet metal or like material susceptible of working such as cutting and bending in certain areas of panel 13 adjacent an aperture A formed therein to seat a handle H embodying my invention.

My improved handle H is especially capable of production by conventional molding techniques from plastics having the desired properties such as infrangibility and resistance to scratching and marring. I have found especially suitable such commercially available plastics as those known in the industry as acrylics, butadienes, styrenes and other having the desired characteristics.

Figure 1:
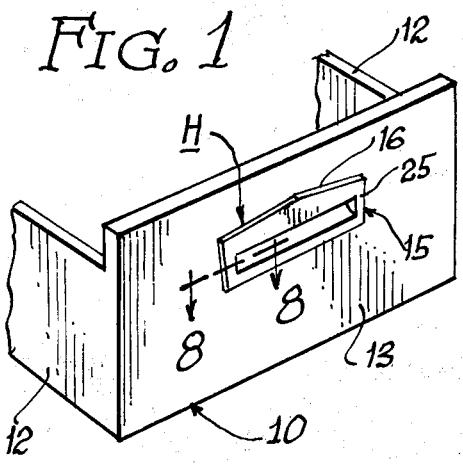
FIG. 1 is a fragmentary front perspective view of a slidable drawer for an article of furniture carrying a drawer pull or handle embodying my invention.

Handle H (FIG. 1) comprises a front plate-like frame portion 15 designed to serve as an escutcheon exposed on the outer face of front panel 13. While I have shown plate 15 as oblong, with an angular bend in its top edge, it will be understood that said plate is susceptible of widely varying esthetic treatment. Thus, said plate might be square, circular, elliptical, etc.

Figure 3:
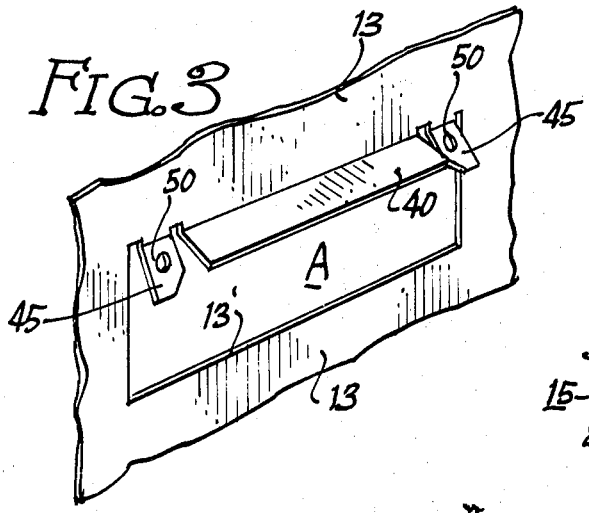
FIG. 3 is a fragmentary rear perspective of the drawer of FIGS. 1 and 2 as prepared for the attachment of a handle as seen in FIGS. 1 and 2.
Figure 6:
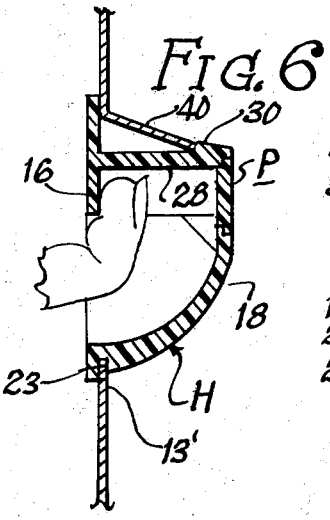
FIG. 6 is a vertical section taken substantially along line 6—6 of FIG. 2.
Figure 8:
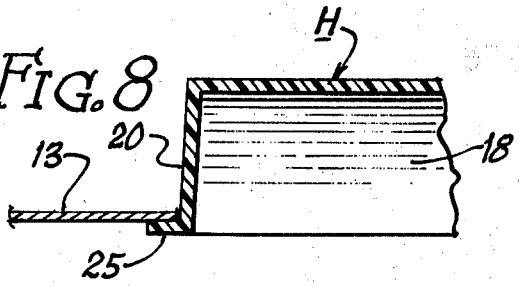
FIG. 8 is a fragmentary horizontal sectional view taken substantially along line 8—8 of FIG. 1.

Extending rearwardly and integral with plate 15 is a cup-like portion adapted to receive a person's fingers for manipulating the drawer, including an upwardly and rearwardly curving plate 18 abutting at its ends integral flat side plates 20—20 which, as seen in FIG. 8, are slightly inclined inwardly and rearwardly in accordance with good molding practice. A longitudinal recess or groove 23 in curvilinear plate 18 permits seating therein an edge 13' of drawer panel 13 adjacent aperture A. (FIGS. 3 and 6.)

It will also be noted that side plates 20 of the handle are spaced a slight distance inwardly of the side edges of escutcheon plate 15, providing side flanges 25 behind which are seated side edges of panel 13 adjacent aperture A. (FIG. 8.)

Figure 5:
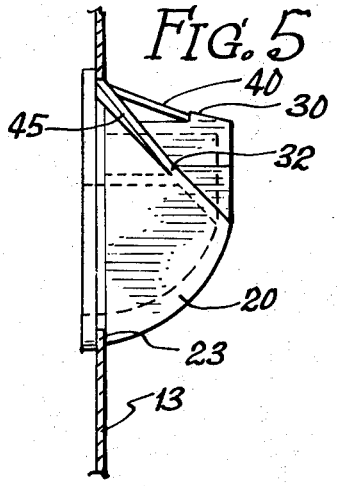
FIG. 5 is a section-elevation as seen substantially along line 5—5 of FIG. 2.

Extending rearwardly from top bar 16 of the handle is an integral flat, generally horizontal bar 28 having a raised shoulder portion 30 formed therein, bar 28 being spaced below the upper extremity of bar 16 (FIGS. 5 and 6) for purposes that will hereinafter appear.

Figure 2:
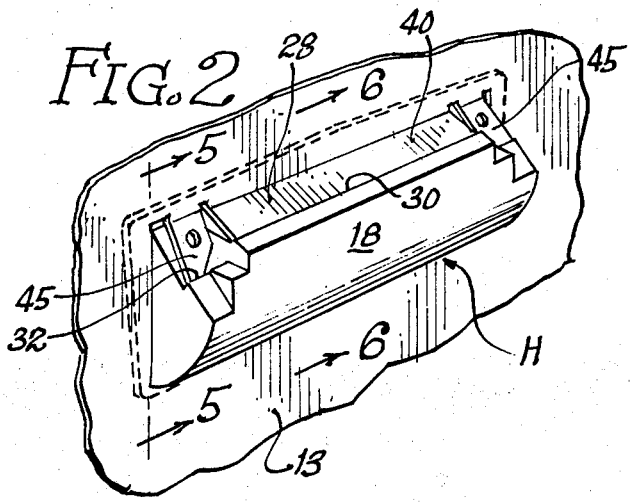
FIG. 2 is a fragmentary rear perspective of the front panel of a drawer such as that of FIG. 1, carrying an embodiment of my invention.
Figure 4:
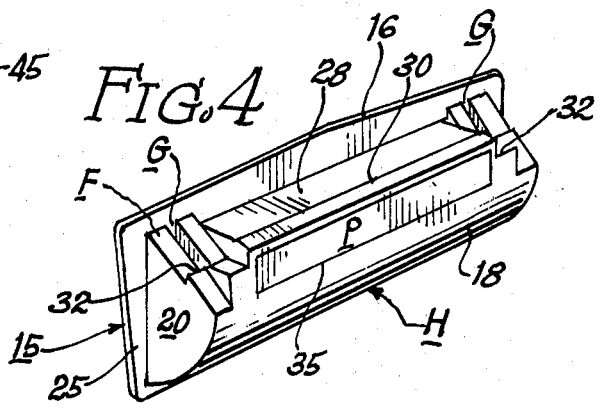
FIG. 4 is a rear perspective of the handle seen in FIGS. 1 and 2.
Figure 7:
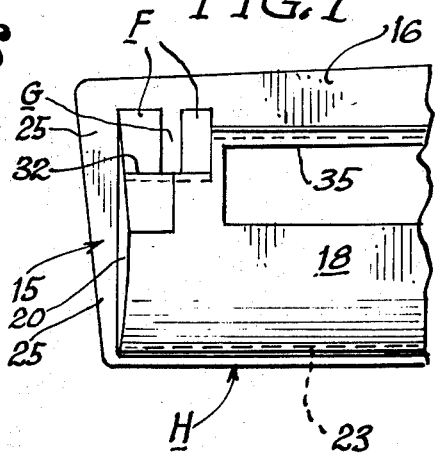
FIG. 7 is a fragmentary rear elevation of the handle of FIG. 4.

Also integral with front plate 15 and side plates 20, 20 are similar bosses 30,30 abutting opposite extremities of plates 20 (FIGS. 2, 4, 7) with top faces F sloping downwardly and rearwardly, with a groove G therebetween, to a shoulder 32.

Handle H, as to all elements hereinabove described, is molded as a unit, leaving an elongated rectangular aperture 35 (FIG. 7) for practical molding considerations apparent to those skilled in the art. Said aperture 35 may be closed, to impart a neat finish, by means of a similarly shaped plate P of similar material, if desired, said plate being secured in place by tongue-and-groove or other suitable connecting means.

DRAWER PANEL

A modicum of work is required on front panel 13 for seating my improved handle, aperture A being deformed from a straight line on only one edge thereof, namely, its upper edge (FIG. 3). Thus, in stamping panel 13, I provide an elongated tab 40 and relatively short tabs 45, all of said tabs being bent at angles suitable to their functions as will now be described.

Assembly of the handle with said front panel is a quick, simple operation, the handle being applied to aperture A from the front side of the panel so that the frame portion of escutcheon plate 15 will overlie the edges of aperture A, as described hereabove and illustrated in the drawings, to provide an attractive, finished appearance. Tabs 40 and 45, being of resilient material, will snap into locking position with the handle, tab 40 against shoulder 30 (FIGS. 5 and 6) and tabs 45, 45 against shoulders 32, 32.

Such assembly is sufficiently secure for most purposes. However, if desired for added security, screws (not shown) may be inserted through apertures 50, 50 provided in tabs 45, 45, engaging the sides of grooves G.

As seen in FIG. 6, top bar 16 of escutcheon plate 15 has a portion 16' depending below bar 28, thus providing space in the upper portion of cup 18 for a person's fingers and an inner surface area of bar portion 16' readily engageable for opening the drawer.

Obviously, the handle may readily be disassembled from the panel if desired, as for replacement, only a screwdriver being required to remove the screws, if employed, and to lift the tabs out of engagement with their respective shoulders.

CONCLUSION

It will be seen that I have provided an improved handle of attractive appearance and of such construction as to be producible at extremely low cost by mass production methods and capable of assembly with a minimum of labor.

Various changes coming within the spirit of my invention may suggest themselves to those skilled in the art. Hence, I do not wish to be limited to the specific form shown or uses mentioned herein, except to the extent indicated in the appended claims.

I claim:

1. In combination with a sheet-material front member for a movable element, said front member having an aperture therein, a handle seated in said aperture comprising a. an escutcheon plate overlapping said aperture on the outer face thereof, b. a cup portion extending rearwardly of the escutcheon plate to facilitate digital manipulation of the movable element and including an upper wall member, c. said upper wall member having an angular shoulder portion on the outer face thereof, and d. a resilient detent member extending downwardly and inwardly from said front member adjacent said aperture, said detent member engaging said shoulder for releasably locking the handle to the front member.

2. A combination as in claim 1, wherein said detent is a finger integral with and bent inwardly from said front member.

3. A combination as in claim 1, wherein a. said upper wall member of the cup member has a plurality of laterally spaced angular ledges formed on its outer face, and b. integral resilient detent means bent inwardly from said front member adjacent the upper edge of the aperture so as to extend downwardly and adapted to be snapped into locking engagement with said ledges, said detent means being priably releasable to permit removal of the handle.

* * * * *